US010608350B2

(12) United States Patent
Morita et al.

(10) Patent No.: US 10,608,350 B2
(45) Date of Patent: Mar. 31, 2020

(54) TERMINAL METAL FITTING AND TERMINAL METAL FITTING-EQUIPPED INSULATING WIRE

(71) Applicant: TATSUTA ELECTRIC WIRE & CABLE CO., LTD., Osaka (JP)

(72) Inventors: Takashi Morita, Kyoto (JP); Masaki Nagamatsu, Kyoto (JP); Daisuke Shimooka, Osaka (JP)

(73) Assignee: TATSUTA ELECTRIC WIRE & CABLE CO., LTD., Osaka (JP)

( * ) Notice: Subject to any disclaimer, the term of this patent is extended or adjusted under 35 U.S.C. 154(b) by 0 days.

(21) Appl. No.: 16/084,516

(22) PCT Filed: Mar. 14, 2017

(86) PCT No.: PCT/JP2017/010242
§ 371 (c)(1),
(2) Date: Sep. 12, 2018

(87) PCT Pub. No.: WO2017/159691
PCT Pub. Date: Sep. 21, 2017

(65) Prior Publication Data

US 2019/0089072 A1 Mar. 21, 2019

(30) Foreign Application Priority Data

Mar. 17, 2016 (JP) ..... 2016-054125

(51) Int. Cl.
*H01R 4/24* (2018.01)
*H01R 4/2495* (2018.01)
*H01R 4/18* (2006.01)

(52) U.S. Cl.
CPC ..... *H01R 4/2495* (2013.01); *H01R 4/184* (2013.01)

(58) Field of Classification Search
CPC ..... H01R 4/2495; H01R 4/184
(Continued)

(56) References Cited

U.S. PATENT DOCUMENTS 3,510,829 A * 5/1970 Keller ..... H01R 4/188 439/421
3,549,786 A * 12/1970 Kuo ..... H01R 4/2404 174/84 C (Continued)

FOREIGN PATENT DOCUMENTS

CN 104081582 A 10/2014
JP S35000060 Y1 1/1960

(Continued)

OTHER PUBLICATIONS

International Search Report dated Jun. 13, 2017 filed in PCT/JP2017/010242.

(Continued)

*Primary Examiner* — Alexander Gilman
(74) *Attorney, Agent, or Firm* — Rankin, Hill & Clark LLP

(57) ABSTRACT

A terminal metal fitting 1 includes a terminal connection portion 2 connected to a partner terminal metal fitting, and a wire holding portion 3 provided at the back of the terminal connection portion 2. The wire holding portion 3 is configured to hold, in a pressure-bonded state, an insulating wire 100 configured such that a core wire is coated by an insulating coating. The wire holding portion 3 includes a bottom wall portion 31 on which the insulating wire 100 is placed, a first insulating wire swaging portion 32 formed continuously to one side edge of the bottom wall portion 31, and a second insulating wire swaging portion 33 formed continuously to the other side edge of the bottom wall portion 31. One or more claws 34 configured to bite into the insulating wire upon swaging of the insulating wire 100 are (Continued)

formed at at least one of the bottom wall portion 31, the first insulating wire swaging portion 32, or the second insulating wire swaging portion 33.

16 Claims, 17 Drawing Sheets

(58) Field of Classification Search
USPC ..... 439/391
See application file for complete search history.

(56) References Cited

U.S. PATENT DOCUMENTS

| | | | | |
|---|---|---|---|---|
| 3,812,448 | A * | 5/1974 | Haitmanek | H01R 4/18 439/421 |
| 3,947,082 | A * | 3/1976 | Bender | H01R 4/2495 439/421 |
| 4,003,623 | A * | 1/1977 | Reynolds | H01R 4/188 439/395 |
| 5,385,483 | A * | 1/1995 | Lin | H01R 4/2404 439/421 |
| 5,522,739 | A * | 6/1996 | Axelsson | H01R 4/20 439/730 |
| 7,210,958 | B1 * | 5/2007 | Jacques | H01R 4/185 439/421 |
| 7,544,892 | B2 * | 6/2009 | Susai | H01R 4/188 174/84 C |
| 8,187,043 | B2 * | 5/2012 | Kumakura | H01R 4/185 29/861 |
| 8,622,774 | B2 * | 1/2014 | Seifert | H01R 4/185 439/882 |
| 9,033,751 | B2 * | 5/2015 | Sato | H01R 4/206 439/877 |
| 9,368,254 | B2 * | 6/2016 | Shanai | H01B 3/421 |
| 9,376,596 | B2 * | 6/2016 | Shanai | H01B 7/0823 |
| 9,425,527 | B2 * | 8/2016 | Mikage | H05K 3/321 |
| 9,455,504 | B2 * | 9/2016 | Kim | H01R 4/28 |
| 9,779,848 | B2 * | 10/2017 | Wu | H01B 1/02 |
| 2014/0322993 | A1 | 10/2014 | Ito | |
| 2015/0229037 | A1 * | 8/2015 | Uchida | H01R 43/01 439/877 |

FOREIGN PATENT DOCUMENTS

| | | | |
|---|---|---|---|
| JP | S47009386 | A | 5/1972 |
| JP | S49082991 | A | 8/1974 |
| JP | S52108585 | U | 8/1977 |
| JP | 2001-185251 | | 7/2001 |
| JP | 2003045534 | A | 2/2003 |
| WO | 2014069580 | A1 | 5/2014 |

OTHER PUBLICATIONS

Office Action dated Jun. 26, 2019 for the corresponding Chinese Patent Application No. 201780015385.0; Machine translation.

Chinese Office Action (CNOA) dated Jan. 15, 2020 for the corresponding Chinese Patent Application No. 201780015385.0 and its partial English machine translation.

* cited by examiner

TERMINAL METAL FITTING AND TERMINAL METAL FITTING-EQUIPPED INSULATING WIRE

TECHNICAL FIELD

The present invention relates to a terminal metal fitting and a terminal metal fitting-equipped insulating wire.

BACKGROUND ART

Patent Literature 1 discloses a terminal metal fitting including a terminal connection portion connected to a partner terminal metal fitting and a wire holding portion formed at the back of the terminal connection portion and configured to hold an insulating wire in a pressure-bonded state. The wire holding portion includes a bottom wall, a pair of wiring coating swaging portions standing from both side edges of a back end portion of the bottom wall, and a pair of core wire swaging portions standing from both side edges of the bottom wall at the front of the wire coating swaging portions. At one end portion (a front end portion) of the insulating wire on a side to be connected to the terminal metal fitting, an insulating coating is removed, and a core wire is exposed. The core wire exposed at the front end portion of the insulating wire is swaged by the core wire swaging portions, and is fixed to the wire holding portion in a state in which conduction is allowed. A front end portion of a portion of the insulating wire coated by the insulating coating is swaged by the wire coating swaging portions, and is fixed to the wire holding portion.

CITATION LIST

Patent Literature

PATENT LITERATURE 1: JP-A-2003-45534

SUMMARY OF THE INVENTION

Problems to be Solved by the Invention

In the terminal metal fitting described in the above Patent Literature 1, the insulating coating of the connection-side end portion of the insulating wire needs to be removed to expose the core wire for electrical and mechanical connection of the insulating wire to the terminal metal fitting.

An object of the present invention is to provide a terminal metal fitting and a terminal metal fitting-equipped insulating wire whose one end portion is attached to the terminal metal fitting. The terminal metal fitting allows electrical and mechanical connection of a connection-side end portion of the insulating wire to the terminal metal fitting without removing an insulating coating of the connection-side end portion of the insulating wire.

Solution to the Problems

A terminal metal fitting according to the present invention includes a terminal connection portion connected to a partner terminal metal fitting, and a wire holding portion provided at the back of the terminal connection portion and configured to hold, in a pressure-bonded state, an insulating wire configured such that a core wire is coated by an insulating coating. The wire holding portion includes a bottom wall portion on which the insulating wire is placed, a first insulating wire swaging portion formed continuously to one side edge of the bottom wall portion, and a second insulating wire swaging portion formed continuously to the other side edge of the bottom wall portion. One or more claws configured to bite into the insulating wire upon swaging of the insulating wire are formed at at least one of the bottom wall portion, the first insulating wire swaging portion and the second insulating wire swaging portion. The claws configured to bite into the insulating wire include not only a claw entering the insulating wire without penetrating the insulating wire, but also a claw entering and penetrating the insulating wire.

One end portion (a connection-side end portion) of the insulating wire is placed on the bottom wall portion of the wire holding portion of the female terminal metal fitting in a state in which the insulating coating is not removed. Then, the insulating wire swaging portions of the wire holding portion are bent to overlap with an upper surface of the bottom wall portion, thereby pressing the insulating wire against the upper surface of the bottom wall portion. In this manner, the connection-side end portion of the insulating wire is fixed to the wire holding portion in a state in which the connection-side end portion is pressed against the bottom wall portion by the first and second insulating wire swaging portions. In this state, the one or more claws formed at at least one of the bottom wall portion, the first insulating wire swaging portion and the second insulating wire swaging portion bite into the insulating coating of the insulating wire. Thus, at least one of the one or more claws is brought into a state in which the claw enters the core wire of the insulating wire or penetrates the core wire. Thus, the core wire and the female terminal metal fitting are electrically connected to each other. That is, in the female terminal metal fitting, the connection-side end portion of the insulating wire can be electrically and mechanically connected to the female terminal metal fitting without removal of the insulating coating of the connection-side end portion of the insulating wire.

In one embodiment of the present invention, each claw is a standing claw.

In one embodiment of the present invention, the one or more claws are formed only at the bottom wall portion among the bottom wall portion, the first insulating wire swaging portion, and the second insulating wire swaging portion.

In one embodiment of the present invention, the one or more claws include claws formed at different positions of the bottom wall portion in a width direction thereof.

In one embodiment of the present invention, the one or more claws are formed at either one of the first insulating wire swaging portion and the second insulating wire swaging portion.

In one embodiment of the present invention, the one or more claws include claws formed at different positions of the insulating wire swaging portion provided with the one or more claws in a direction perpendicular to each side edge of the bottom wall portion.

In one embodiment of the present invention, the lengths of the first insulating wire swaging portion and the second insulating wire swaging portion in the direction perpendicular to each side edge of the bottom wall portion are formed as such lengths that both insulating wire swaging portions at least partially overlap with each other when one insulating wire swaging portion is bent to overlap with the upper surface of the bottom wall portion after the other insulating wire swaging portion has been bent to overlap with the upper surface of the bottom wall portion in a state in which the connection-side end portion of the insulating wire is placed on the bottom wall portion.

In one embodiment of the present invention, the one or more claws are formed at each of the bottom wall portion, the first insulating wire swaging portion, and the second insulating wire swaging portion.

In one embodiment of the present invention, the one or more claws are formed at each of the first insulating wire swaging portion and the second insulating wire swaging portion among the bottom wall portion, the first insulating wire swaging portion, and the second insulating wire swaging portion.

In one embodiment of the present invention, the lengths of the first insulating wire swaging portion and the second insulating wire swaging portion in the direction perpendicular to each side edge of the bottom wall portion are formed as such lengths that both insulating wire swaging portions do not overlap with each other when one insulating wire swaging portion is bent to overlap with the upper surface of the bottom wall portion after the other insulating wire swaging portion has been bent to overlap with the upper surface of the bottom wall portion in a state in which the connection-side end portion of the insulating wire is placed on the bottom wall portion.

A terminal metal fitting-equipped insulating wire according to the present invention includes the terminal metal fitting according to the present invention, and an insulating wire whose one end portion is electrically and mechanically connected to the wire holding portion of the terminal metal fitting.

The above-described object, features, and advantageous effects of the present invention and other objects, features, and advantageous effects of the present invention are apparent from description of the embodiments below with reference to the attached drawings.

DESCRIPTION OF THE EMBODIMENTS

Hereinafter, an embodiment of the present invention will be described in detail with reference to the attached drawings.

Figure 1:
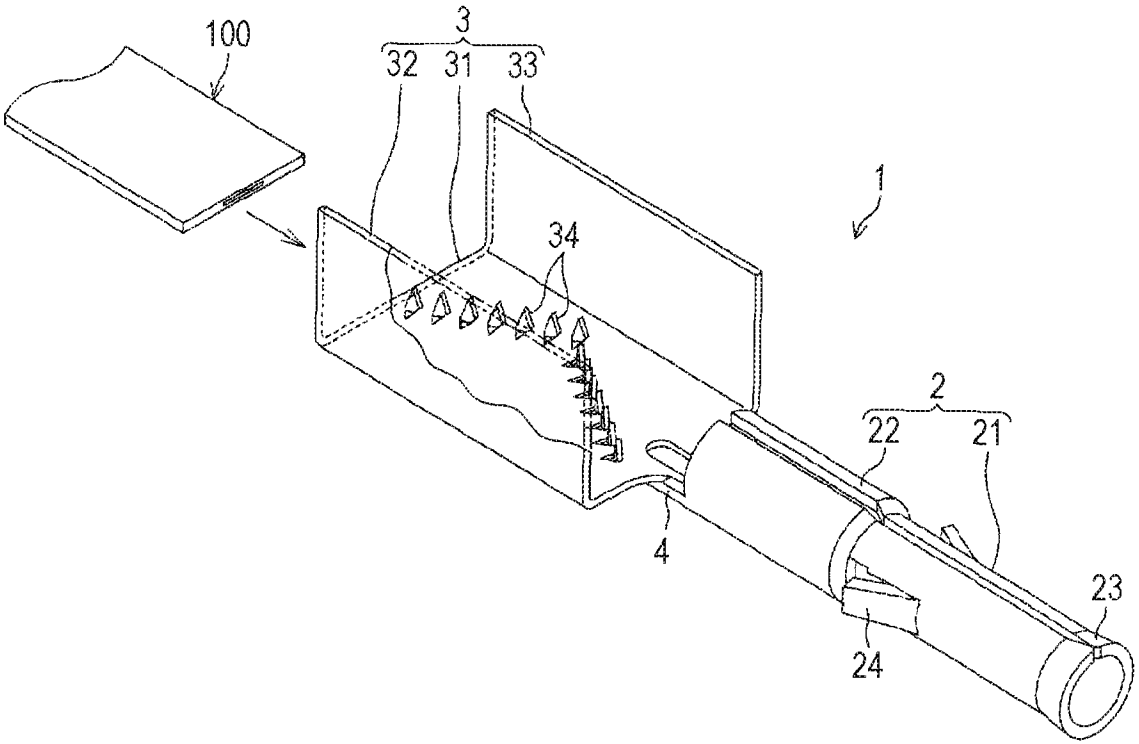
FIG. 1 is a partially-cutaway perspective view of an embodiment in a case where the present invention is applied to a female terminal metal fitting.
Figure 2:
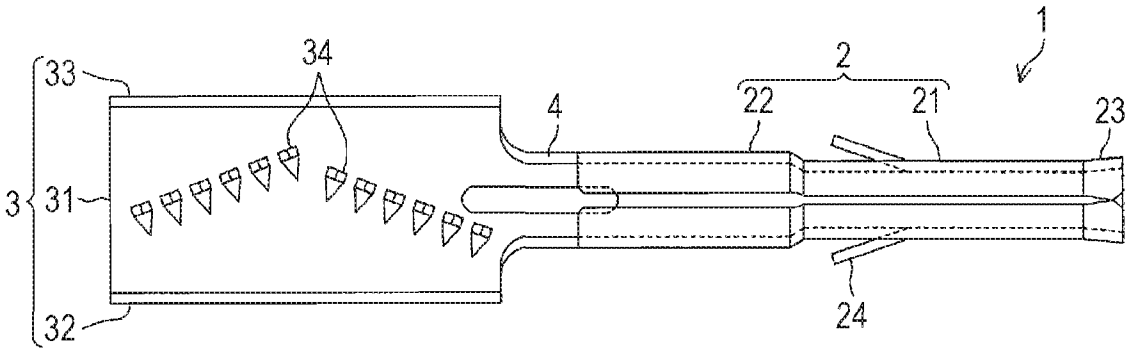
FIG. 2 is a plan view of the female terminal metal fitting of FIG. 1.
Figure 3:
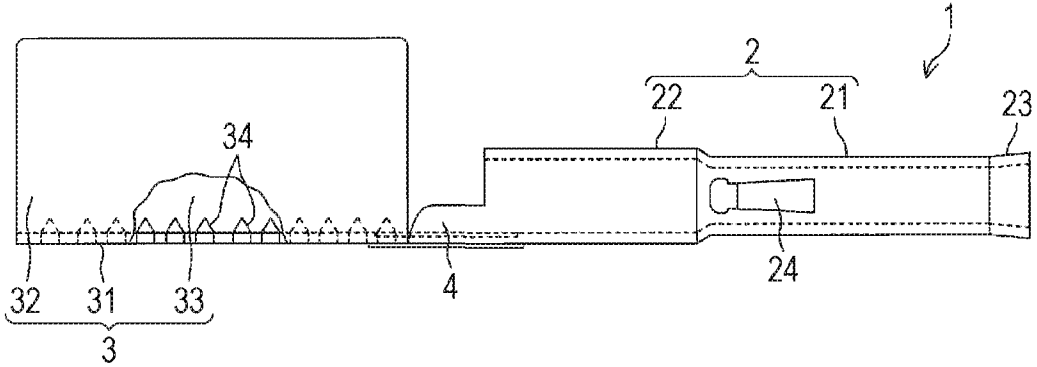
FIG. 3 is a partially-cutaway side view of the female terminal metal fitting of FIG. 1.
Figure 4:
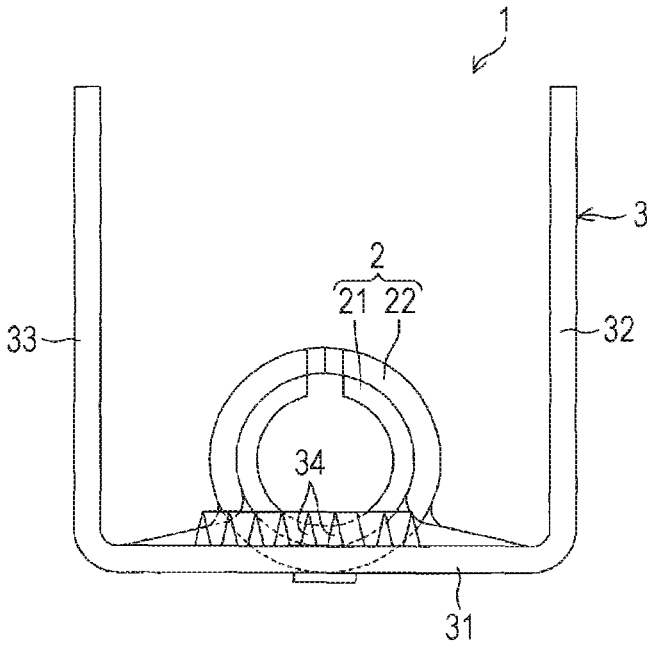
FIG. 4 is an enlarged back view of the female terminal metal fitting of FIG. 1.

FIG. 1 is a perspective view of the embodiment in a case where the present invention is applied to a female terminal metal fitting. FIG. 2 is a plan view of the female terminal metal fitting of FIG. 1. FIG. 3 is a partially-cutaway side view of the female terminal metal fitting of FIG. 1. FIG. 4 is an enlarged back view of the female terminal metal fitting of FIG. 1.

The female terminal metal fitting (a socket) 1 is formed in such a manner that, e.g., bending is performed for a conductive plate-shaped body in a predetermined shape. The female terminal metal fitting 1 includes a terminal connection portion 2, a wire holding portion 3, and a coupling portion 4. The terminal connection portion 2 extends in a front-to-back direction, and is connected to a partner terminal metal fitting (in the present embodiment, a male terminal metal fitting (a plug)) (not shown). The wire holding portion 3 is provided at the back of the terminal connection portion 2, and is configured to hold an insulating wire 100 in a pressure-bonded state. The coupling portion 4 is configured to couple the terminal connection portion 2 and the wire holding portion 3 to each other.

The terminal connection portion 2 is formed in such a manner that a substantially front half portion of the conductive plate-shaped body as the material of the female terminal metal fitting 1 is bent in a cylindrical shape. The terminal connection portion 2 includes a first cylindrical portion 21 and a second cylindrical portion 22 continuously extending from the back of the first cylindrical portion 21 and having a greater diameter than that of the first cylindrical portion 21. The cross-sectional shapes of the first cylindrical portion 21 and the second cylindrical portion 22 are a non-endless annular shape disconnected at one spot right above the center.

The first cylindrical portion 21 has, on a front end side thereof, a tapered end portion 23 whose diameter increases toward the front. The tapered end portion 23 facilitates insertion of the male terminal metal fitting into the terminal connection portion 2. A pair of detachment prevention pieces 24 is provided at both side portions of the first cylindrical portion 21. The pair of the detachment prevention pieces 24 suppress detachment of a later-described terminal cover (a cap) 50 (see FIG. 9) from the female terminal metal fitting 1 when the terminal cover 50 is attached to the female terminal metal fitting 1. The pair of the detachment prevention pieces 24 is formed in such a manner that part of both side portions of the first cylindrical portion 21 is cut and raised outward. Front ends of the pair of the detachment prevention pieces 24 are each continuous to both side portions of the first cylindrical portion 21. The pair of the detachment prevention pieces 24 extends diagonally outward to the back such that an interval between the detachment prevention pieces 24 increases toward the back.

The coupling portion 4 has a half cylindrical shape formed continuously to a substantially lower half portion of a back end of the second cylindrical portion 22 and having a U-shaped section.

The wire holding portion 3 includes a bottom wall portion 31 and a pair of insulating wire swaging portions 32, 33. The bottom wall portion 31 is continuous to the coupling portion 4, and has a rectangular shape elongated in the front-to-back direction as viewed in the plane. The pair of the insulating wire swaging portions 32, 33 stands from both side edges of the bottom wall portion 31. Hereinafter, one insulating wire swaging portion 32 will be, in some cases, referred to as a "first insulating wire swaging portion 32," and the other insulating wire swaging portion 33 will be referred to as a "second insulating wire swaging portion 33." As viewed in the plane, the width of the bottom wall portion 31 is greater than that of the coupling portion 4. Each of the insulating wire swaging portions 32, 33 has a rectangular shape elongated in the front-to-back direction as viewed from the side. The standing length (a length in a direction perpendicular to the side edge of the bottom wall portion 31) of each of the insulating wire swaging portions 32, 33 is formed as such a length that both insulating wire swaging portions at least partially overlap with each other when one insulating wire swaging portion is bent to overlap with an upper surface of the bottom wall portion 31 after the other insulating wire swaging portion has been bent to overlap with the upper surface of the bottom wall portion 31 in a state in which one end portion of the insulating wire 100 is placed on the bottom wall portion 31.

Standing claws 34 are formed at the bottom wall portion 31. The standing claws 34 are formed in such a manner that part of the bottom wall portion 31 is cut and raised upward. Each standing claw 34 has a triangular shape pointed upward as viewed from the side. A base portion of each standing claw 34 is continuous to the bottom wall portion 31. In the present embodiment, in a region from a front end to the center of the bottom wall portion 31 in a length direction thereof, the standing claws 34 are formed with a spacing along a first virtual line. The first virtual line extends diagonally backward from the position of a front end portion of the bottom wall portion 31 closer to the first insulating wire swaging portion 32 toward the position of a center portion of the bottom wall portion 31 in the length direction closer to the second insulating wire swaging portion 33. Meanwhile, in a region from the center to a back end of the bottom wall portion 31 in the length direction, the standing claws 34 are formed with a spacing along a second virtual line. The second virtual line extends diagonally backward from the position of the center portion of the bottom wall portion 31 in the length direction closer to the second insulating wire swaging portion 33 toward the position of a back end portion of the bottom wall portion 31 closer to the first insulating wire swaging portion 32. That is, the standing claws 34 include standing claws 34 formed at different positions in a width direction of the bottom wall portion 31.

Figure 5:
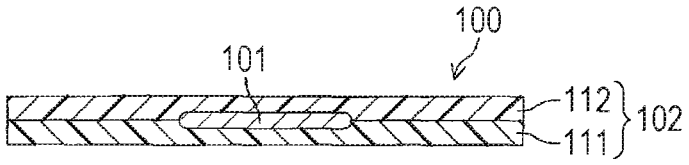
FIG. 5 is an enlarged sectional view of a cross section of an insulating wire.

FIG. 5 is an enlarged sectional view of a cross section of the insulating wire 100.

The insulating wire 100 includes a core wire 101 formed from a conductive body with a horizontally-elongated rectangular cross section, and a band-shaped insulating coating 102 coating the core wire 101. In the present embodiment, the insulating coating 102 includes two pieces of band-shaped non-woven fabric 111, 112. Two pieces of the band-shaped non-woven fabric 111, 112 are bonded to each other in a state in which these pieces overlap with each other with the core wire 101 being sandwiched in an upper-to-lower direction. The core wire 101 extends at a substantially center portion in a width direction between the non-woven fabric 111 and the non-woven fabric 112. Two pieces of the non-woven fabric 111, 112 are bonded to each other in such a manner that a hot-melt adhesive layer such as polyethylene (not shown) formed on opposing surfaces of the non-woven fabric 111, 112 is heated.

Figure 6:
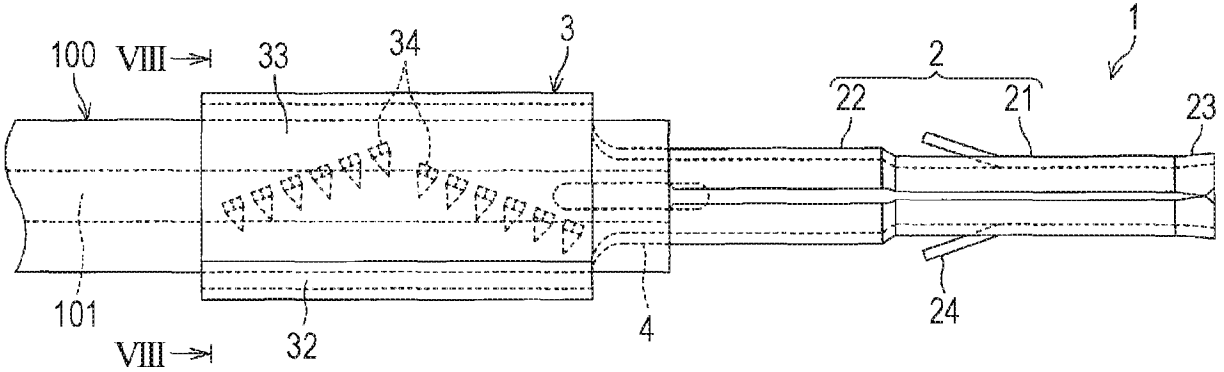
FIG. 6 is a plan view of a state in which the insulating wire is fixed to the female terminal metal fitting of FIG. 1.
Figure 7:
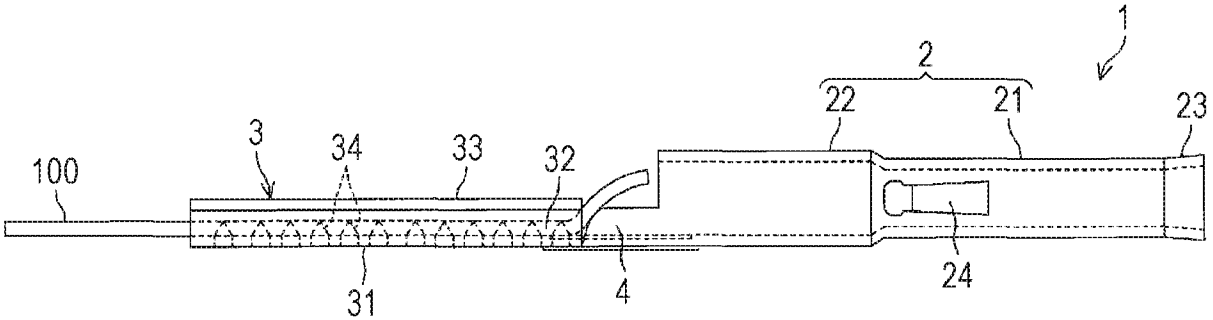
FIG. 7 is a side view of FIG. 6.
Figure 8:
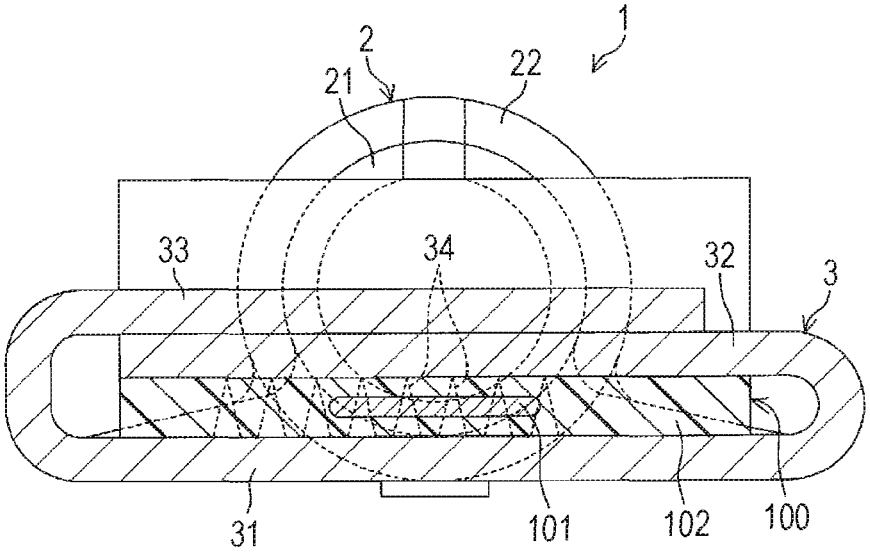
FIG. 8 is an enlarged sectional view along a VIII-VIII line of FIG. 6.

FIG. 6 is a plan view of a state in which the insulating wire 100 is fixed to the female terminal metal fitting 1. FIG. 7 is a side view of FIG. 6. FIG. 8 is an enlarged sectional view along a VIII-VIII line.

First, one end portion (a connection-side end portion) of the insulating wire 100 is placed on the bottom wall portion 31 of the wire holding portion 3 of the female terminal metal fitting 1 in a state in which the insulating coating 102 is not removed. Then, one insulating wire swaging portion 32 of the wire holding portion 3 is bent to overlap with the upper surface of the bottom wall portion 31, and the insulating wire 100 is pressed against the upper surface of the bottom wall portion 31. Thereafter, the other insulating wire swaging portion 33 is bent to overlap with an upper surface of one insulating wire swaging portion 32, and one insulating wire swaging portion 32 is pressed against the insulating wire 100. In this manner, large portions of both insulating wire swaging portions 32, 33 overlap with each other. Thus, the connection-side end portion of the insulating wire 100 is fixed to the wire holding portion 3 with the connection-side end portion being pressed against the bottom wall portion 31 by the insulating wire swaging portions 32, 33. In this state, the standing claws 34 formed at the bottom wall portion 31 bite into the insulating coating 102 of the insulating wire 100. Accordingly, a state in which at least some of the standing claws 34 among the standing claws 34 bite into the core wire 101 of the insulating wire 100 or penetrate the core wire 101 is brought. Thus, the core wire 101 and the female terminal metal fitting 1 are electrically connected to each other.

That is, in the female terminal metal fitting 1 according to the present embodiment, the connection-side end portion of the insulating wire 100 can be, without removing the insulating coating of the connection-side end portion of the insulating wire 100, electrically and mechanically connected to the female terminal metal fitting 1. Moreover, in the present embodiment, the standing claws 34 include the standing claws 34 each formed at the different positions of the bottom wall portion 31 in the width direction. Thus, even in a case where the core wire 101 of the insulating wire 100 is formed at a position shifted from the center position of the insulating coating 102 in a width direction thereof, the core wire 101 can be electrically connected to the female terminal metal fitting 1.

Figure 9:
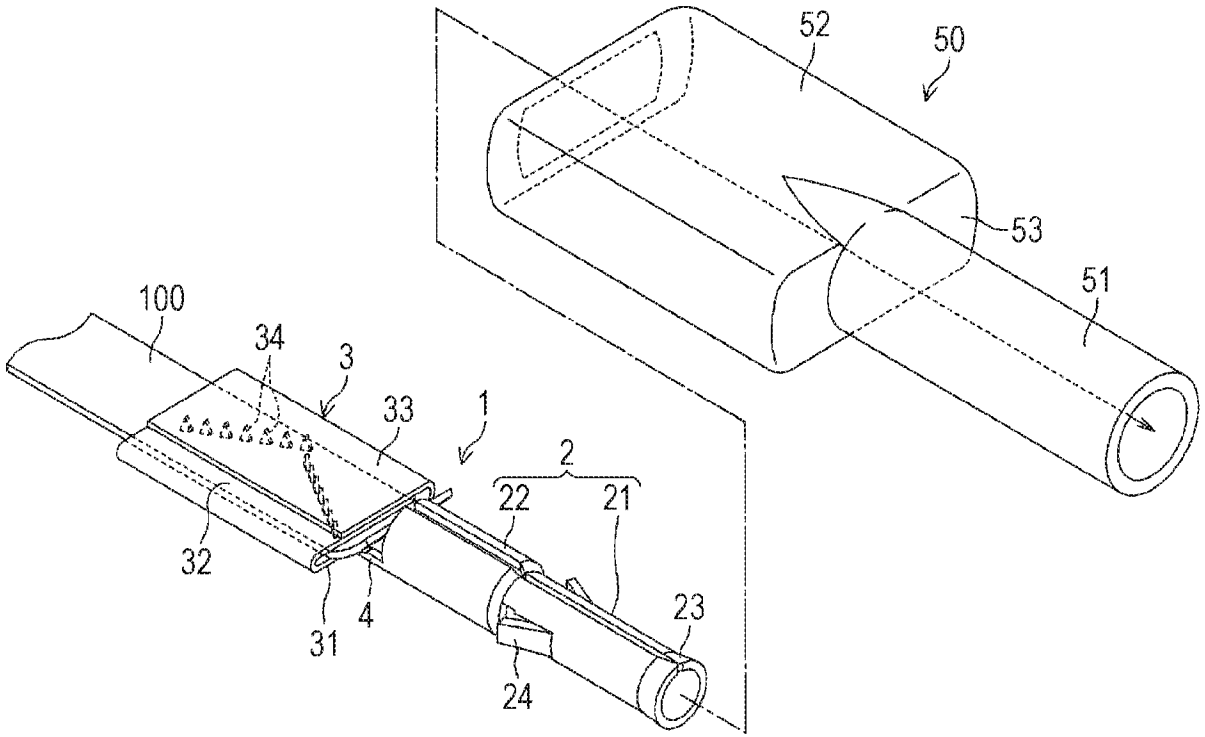
FIG. 9 is an exploded perspective view of the female terminal metal fitting of FIG. 1 and a cover attached thereto.
Figure 10:
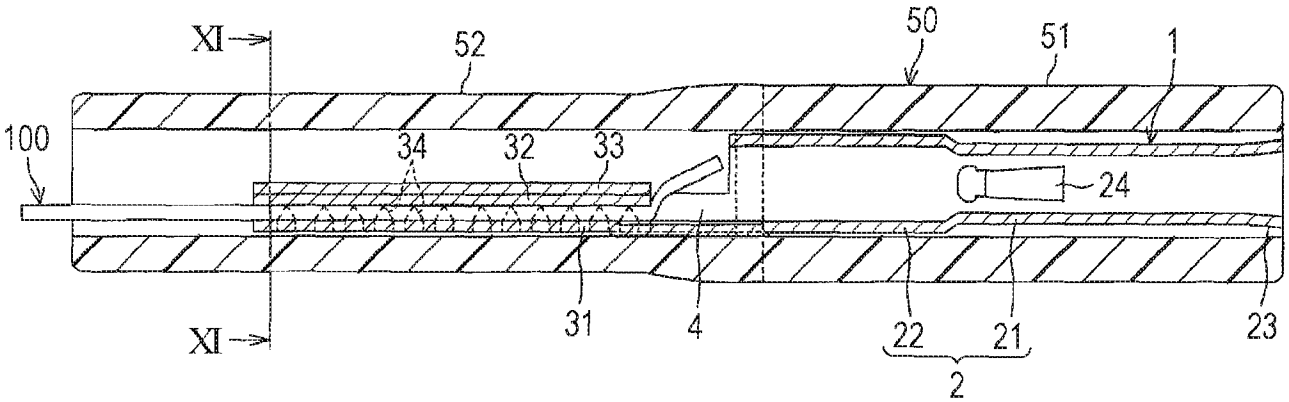
FIG. 10 is a longitudinal sectional view of a state in which the cover is attached to the female terminal metal fitting of FIG. 1.
Figure 11:
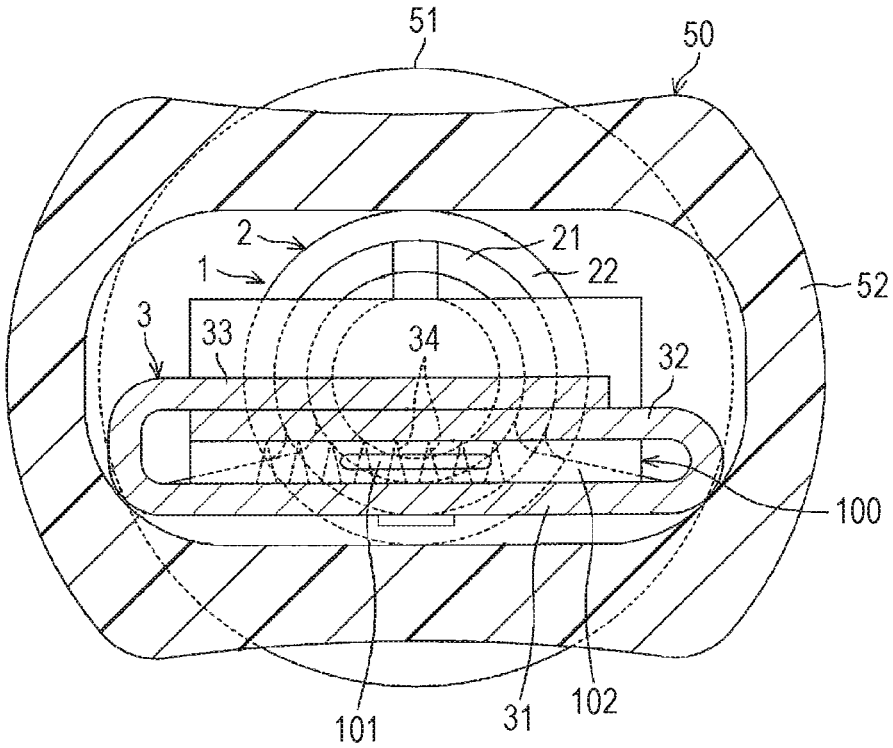
FIG. 11 is an enlarged sectional view along an XI-XI line of FIG. 10.

FIG. 9 is an exploded perspective view of the female terminal metal fitting 1 and the terminal cover 50 attached thereto. FIG. 10 is a longitudinal sectional view of a state in which the terminal cover 50 is attached to the female terminal metal fitting 1. FIG. 11 is an enlarged sectional view along an XI-XI line of FIG. 10.

The terminal cover 50 includes a front-side cylindrical portion 51 having a tubular shape, and a back-side rectangular tubular portion 52. The terminal connection portion 2 of the female terminal metal fitting 1 is inserted into the cylindrical portion 51. The coupling portion 4 and the wire holding portion 3 of the female terminal metal fitting 1 are inserted into the rectangular tubular portion 52. The cross-sectional shape of the cylindrical portion 51 is a ring shape. The cylindrical portion 51 opens at both ends thereof. A pair of right and left engagement recessed portions (not shown) is formed at an inner peripheral surface of the cylindrical portion 51. When the terminal connection portion 2 of the female terminal metal fitting 1 is inserted, the pair of the right and left engagement recessed portions engages with the detachment prevention pieces 24 of the terminal connection portion 2.

The cross-sectional shape of the rectangular tubular portion 52 is a horizontally-elongated rectangular annular shape. The sectional shape of a hollow portion of the rectangular tubular portion 52 is a horizontally-elongated rectangular shape in which each corner portion is curved in an outwardly-raised shape. The rectangular tubular portion 52 opens at a back end thereof. The rectangular tubular portion 52 has, at a front end thereof, a front end wall 53. A through-hole communicating with a hollow portion of the cylindrical portion 51 is formed at a center portion of the front end wall 53. A back end portion of the cylindrical portion 51 is coupled to a peripheral edge portion of the through-hole at an outer surface of the front end wall 53 of the rectangular tubular portion 52. The cylindrical portion 51 and the rectangular tubular portion 52 are integrally formed from an insulating material such as synthetic resin.

Attachment of the terminal cover 50 to the female terminal metal fitting 1 fixed to the insulating wire 100 is performed in such a manner that the female terminal metal fitting 1 is inserted into a hollow portion of the terminal cover 50 from a back end side of the terminal cover 50. Insertion of the female terminal metal fitting 1 into the hollow portion of the terminal cover 50 is performed until the terminal connection portion 2 of the female terminal metal fitting 1 is inserted into the cylindrical portion 51 of the terminal cover 50. Accordingly, a state is brought, in which the terminal connection portion 2 of the female terminal metal fitting 1 is inserted into the cylindrical portion 51 of the terminal cover 50 and the coupling portion 4 and the wire holding portion 3 of the female terminal metal fitting 1 are inserted into the rectangular tubular portion 52 of the terminal cover 50. In this state, the detachment prevention pieces 24 of the female terminal metal fitting 1 each engage with the engagement recessed portions (not shown) formed at the inner peripheral surface of the cylindrical portion 51. Thus, the female terminal metal fitting 1 is less detachable from the terminal cover 50. In other words, the terminal cover 50 is less detachable from the female terminal metal fitting 1.

The embodiment of the present invention has been described above. The present invention can be implemented in other forms. For example, in the above-described embodiment, the standing claws 34 are, at the bottom wall portion 31 of the wire holding portion 3, formed with the spacing along the above-described first and second virtual lines. The standing claws 34 may be formed at the bottom wall portion 31 in other arrangement patterns.

Figure 12:
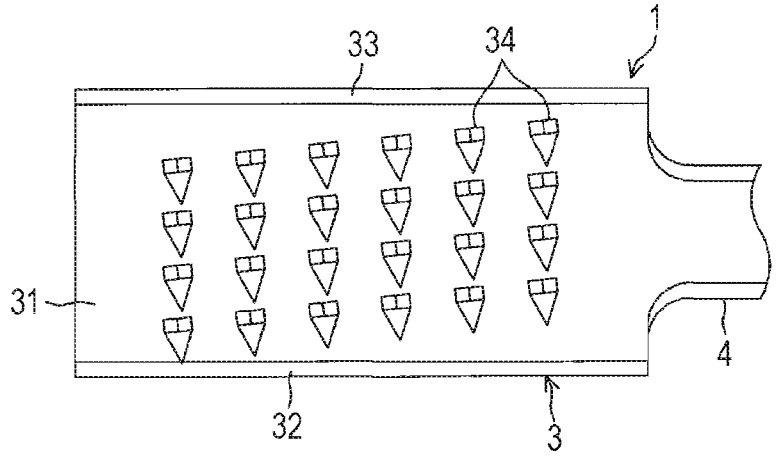
FIG. 12 is a partial plan view of another example of an arrangement pattern of standing claws.
Figure 13:
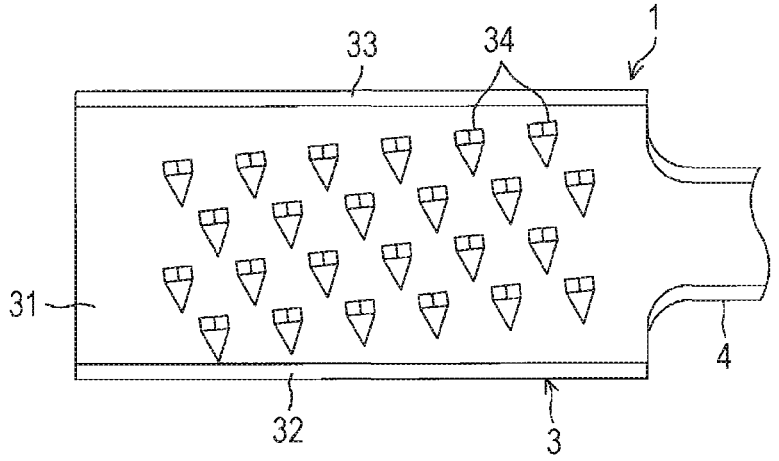
FIG. 13 is a partial plan view of still another example of the arrangement pattern of the standing claws.

For example, as illustrated in FIG. 12, the standing claws may be formed at the bottom wall portion 31 of the wire holding portion 3 in a matrix pattern as viewed in the plane. Alternatively, as illustrated in, e.g., FIG. 13, the standing claws may be formed at the bottom wall portion 31 of the wire holding portion 3 in a zigzag pattern as viewed in the plane. In any arrangement pattern, the standing claws 34 include the standing claws 34 formed at the different positions of the bottom wall portion 31 in the width direction.

Figure 14:
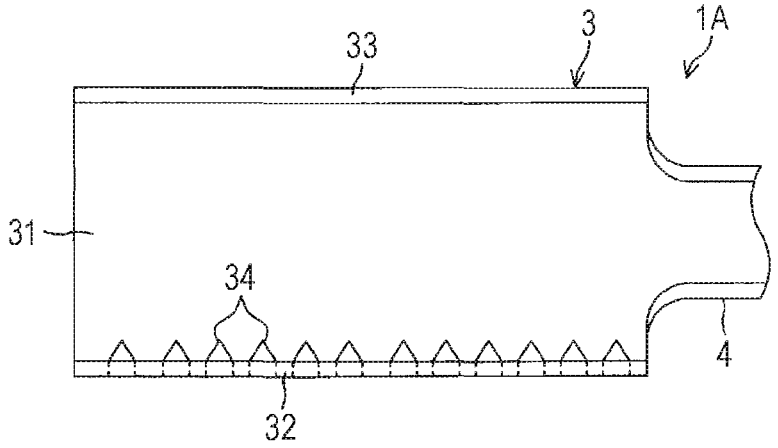
FIG. 14 is a partial plan view of an example of a female terminal metal fitting configured such that standing claws are formed at an insulating wire swaging portion.
Figure 15:
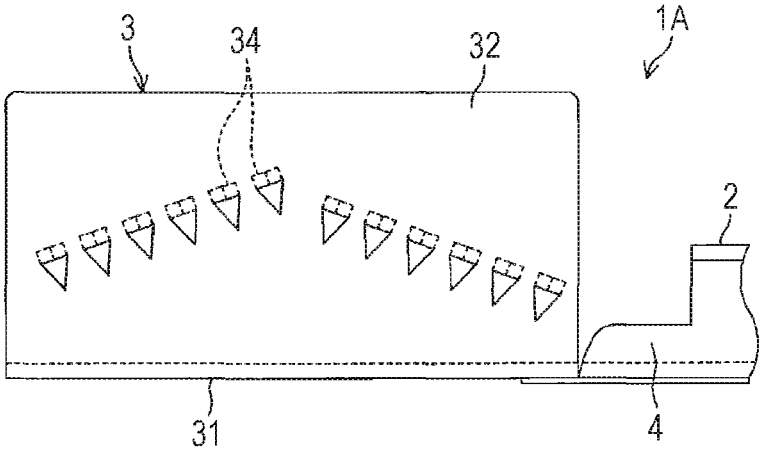
FIG. 15 is a side view of FIG. 14.
Figure 16:
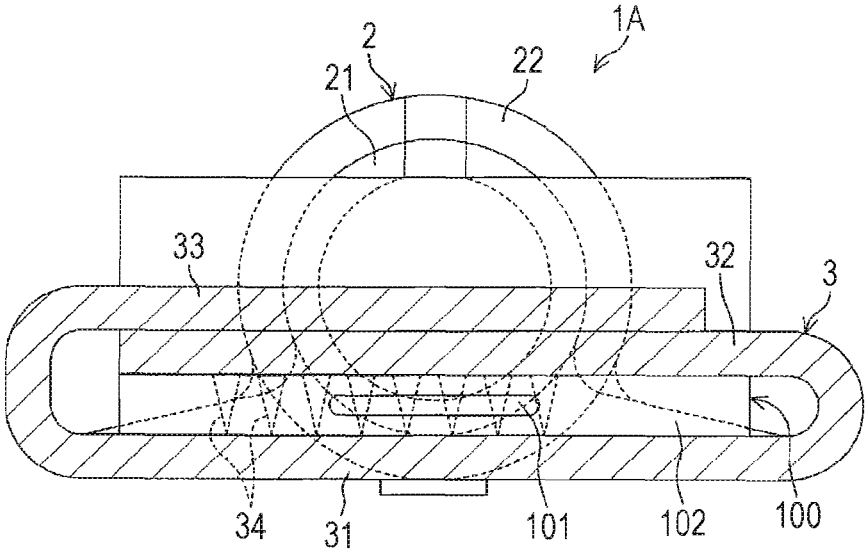
FIG. 16 is a sectional view of a state in which an insulating wire is fixed to the female terminal metal fitting of FIG. 14.

Alternatively, the standing claws 34 may be provided not at the bottom wall portion 31 of the wire holding portion 3 but at one of the first insulating wire swaging portion 32 or the second insulating wire swaging portion 33. FIGS. 14 and 15 illustrate a female terminal metal fitting 1A configured such that standing claws 34 are formed only at a first insulating wire swaging portion 32 among a bottom wall portion 31, the first insulating wire swaging portion 32, and a second insulating wire swaging portion 33. In the female terminal metal fitting 1A illustrated in FIGS. 14 and 15, the arrangement pattern of the standing claws 34 is similar to that of the above-described embodiment, but the standing claws 34 may be formed in the matrix pattern or the zigzag pattern. In any arrangement pattern, the standing claws 34 include standing claws 34 formed at different positions of the first insulating wire swaging portion 32 in a standing direction thereof. As described above, in a case where the standing claws 34 are formed only at one insulating wire swaging portion 32, the insulating wire swaging portion 32 provided with the standing claws 34 is first bent upon fixing of the insulating wire, and then, the other insulating wire swaging portion 33 is bent, as illustrated in FIG. 16.

Note that the standing claws 34 may be formed only at the second insulating wire swaging portion 33 among the bottom wall portion 31, the first insulating wire swaging portion 32, and the second insulating wire swaging portion 33. In this case, upon fixing of the insulating wire, the second insulating wire swaging portion 33 is first bent, and then, the first insulating wire swaging portion 32 is bent.

In the above-described embodiment, the standing length of each of the insulating wire swaging portions 32, 33 is formed as such a length that both insulating wire swaging portions at least partially overlap with each other when one insulating wire swaging portion is bent to overlap with the upper surface of the bottom wall portion 31 after the other insulating wire swaging portion has been bent to overlap with the upper surface of the bottom wall portion 31 in a state in which one end portion of the insulating wire 100 is placed on the bottom wall portion 31.

Figure 17:
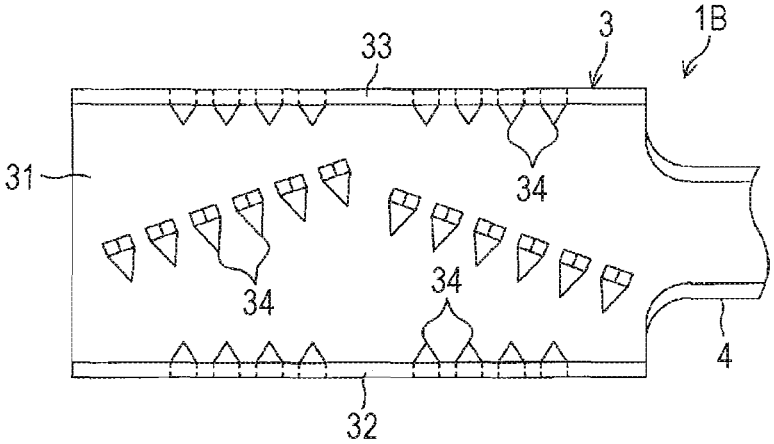
FIG. 17 is a partial plan view of an example of a female terminal metal fitting configured such that the standing length of each insulating wire swaging portion is formed as such a length that both insulating wire swaging portions do not overlap with each other upon fixing of an insulating wire.
Figure 18:
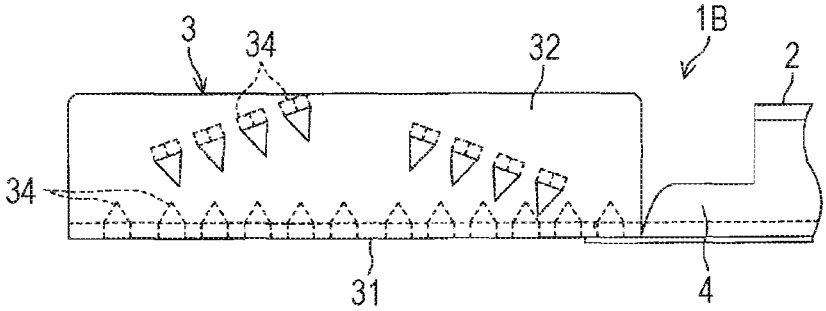
FIG. 18 is a side view of FIG. 17.
Figure 19:
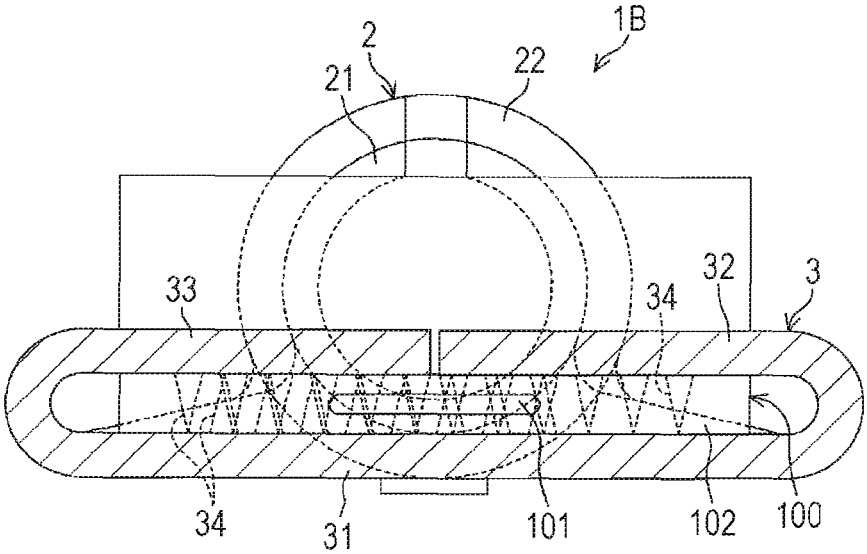
FIG. 19 is a sectional view of a state in which the insulating wire is fixed to the female terminal metal fitting of FIG. 17.

However, as in a female terminal metal fitting 1B illustrated in FIGS. 17 to 19, the standing length of each of the insulating wire swaging portions 32, 33 may be formed as such a length that both insulating wire swaging portions do not overlap with each other when one insulating wire swaging portion is bent to overlap with an upper surface of a bottom wall portion 31 after the other insulating wire swaging portion has been bent to overlap with the upper surface of the bottom wall portion 31 in a state in which one end portion of an insulating wire 100 is placed on the bottom wall portion 31.

In this case, as illustrated in FIGS. 17 to 19, one or more standing claws 34 may be formed at each of the bottom wall portion 31, the first insulating wire swaging portion 32, and the second insulating wire swaging portion 33. In this case, upon fixing of the insulating wire, one of the insulating wire swaging portions is bent to overlap with the upper surface of the bottom wall portion 31 in a state in which one end portion of the insulating wire 100 is placed on the bottom wall portion 31. Thereafter, the other insulating wire swaging portion is bent to overlap with the upper surface of the bottom wall portion 31. Note that both insulating wire swaging portions 32, 33 may be simultaneously bent to overlap with the upper surface of the bottom wall portion 31 in a state in which one end portion of the insulating wire 100 is placed on the bottom wall portion 31.

In a case where the standing length of each of the insulating wire swaging portions 32, 33 is formed as such a length that both portions do not overlap with each other upon fixing of the insulating wire, one or more standing claws 34 may be formed at at least one of the bottom wall portion 31, the first insulating wire swaging portion 32, or the second insulating wire swaging portion 33. For example, one or more standing claws 34 may be, with no standing claws being formed at the bottom wall portion 31, formed at each of the first insulating wire swaging portion 32 and the second insulating wire swaging portion 33.

Figure 20:
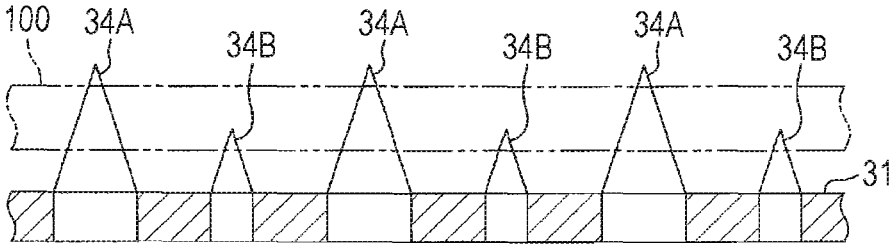
FIG. 20 is an enlarged sectional view of another example of the standing claw.

The form (the shape) of the standing claw 34 is not limited to the form described above in the embodiment. For example, as illustrated in FIG. 20, the standing claws may include a variety of types of standing claws 34A, 34B with different blade heights. FIG. 20 illustrates the standing claws 34A, 34B each formed in such a manner that part of the bottom wall portion is cut and raised. The standing claw may be formed in such a manner that part of the insulating wire swaging portion 32, 33 is cut and raised. The same applies hereinafter.

Figure 21A:
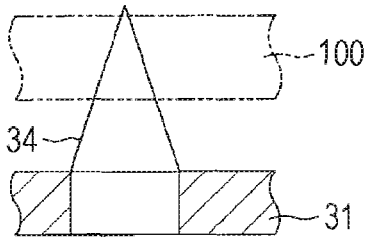
FIG. 21A is an enlarged sectional view of still another example of the standing claw.
Figure 21B:
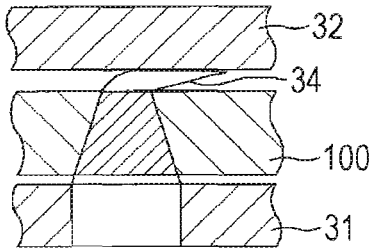
FIG. 21B is an enlarged sectional view of the standing claw after an insulating wire has been fixed.

As illustrated in FIGS. 21A and 21B, the standing claw 34 may be in such a form that the standing claw 34 penetrates the insulating wire 100 and a tip end of the standing claw 34 is folded back in a state in which the insulating wire 100 is fixed.

Figure 22A:
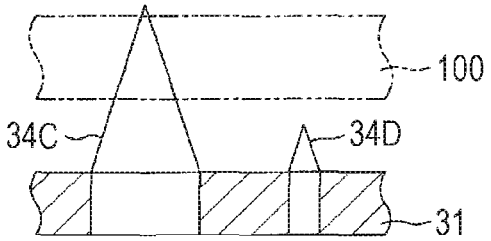
FIG. 22A is an enlarged sectional view of still another example of the standing claw.
Figure 22B:
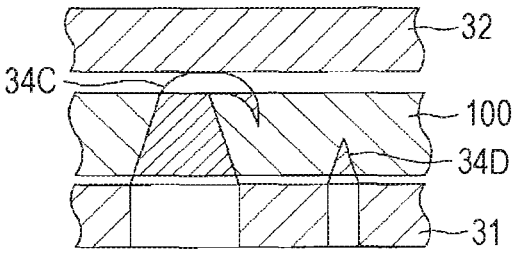
FIG. 22B is an enlarged sectional view of the standing claw after an insulating wire has been fixed.

Alternatively, as illustrated in FIGS. 22A and 22B, the standing claws 34 may include a standing claw 34C with a great blade height, and a standing claw 34D with a small blade height in a state in which the insulating wire 100 is fixed. The standing claw 34C with the great blade height penetrates the insulating wire 100, and has a folded-back tip end. The standing claw 34D with the small blade height enters the insulating wire 100, but does not penetrate the insulating wire 100.

Figure 23A:
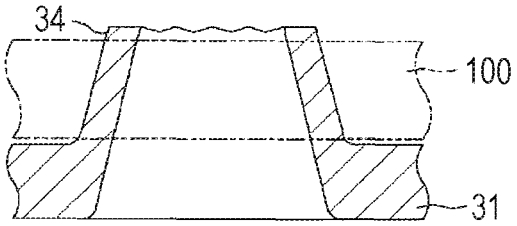
FIG. 23A is an enlarged sectional view of still another example of the standing claw.
Figure 23B:
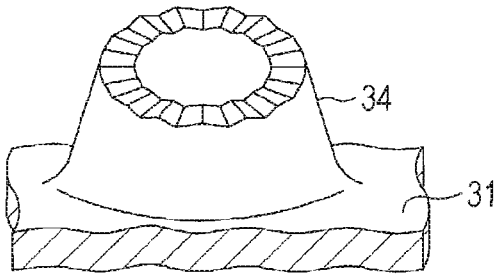
FIG. 23B is an enlarged sectional view of the standing claw.

Alternatively, as illustrated in FIGS. 23A and 23B, the standing claw 34 may be in such a form that the standing claw 34 has a tubular shape whose outer diameter decreases toward a protruding end side and a protruding end has burrs.

Figure 24:
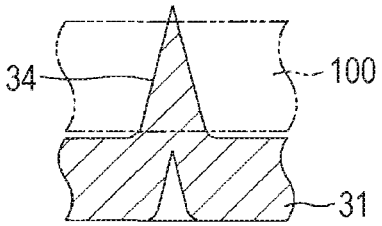
FIG. 24 is an enlarged sectional view of still another example of the standing claw.

Alternatively, as illustrated in FIG. 24, the standing claw 34 may have a substantially conical shape.

Figure 25:
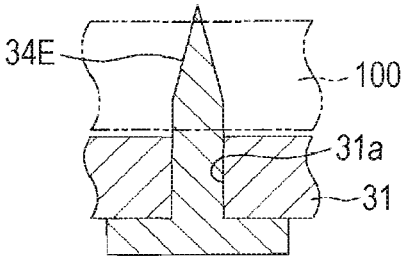
FIG. 25 is a sectional view of an example of other claws than the standing claw.

Alternatively, other claws than the standing claw may be used instead of the standing claw 34. For example, as illustrated in FIG. 25, a thumbtack-shaped claw 34E having a needle portion may be used. In the example of FIG. 25, a claw fixing hole 31*a* may be formed at the bottom wall portion 31. The claw 34E is fixed to the bottom wall portion 31 in a state in which the needle portion of the claw 34E is inserted into the claw fixing hole 31*a* from below.

The embodiment in a case where the present invention is applied to the female terminal metal fitting has been described above. The present invention is applicable to a male terminal metal fitting (a plug). In the case of applying the present invention to the male terminal metal fitting, the terminal connection portion 2 among the terminal connection portion 2, the wire holding portion 3, and the coupling portion 4 of the female terminal metal fitting 1, 1A, 1B may be changed to a terminal connection portion to be connected to a female terminal metal fitting (a socket).

The embodiments of the present invention have been described in detail. These embodiments are merely specific examples used for the sake of clear description of the technical contents of the present invention. The present invention shall not be interpreted limited to these specific examples. The scope of the present invention is limited only by the scope of the attached claims.

This application corresponds to Japanese Patent Application No. 2016-54125 filed to the Japan Patent Office on Mar. 17, 2016, the entire disclosure thereof is herein incorporated by reference.

LIST OF REFERENCE NUMERALS

1, 1A, 1B Female terminal metal fitting
2 Terminal connection portion
3 Wire holding portion
4 Coupling portion
21 First cylindrical portion
22 Second cylindrical portion
23 Tapered portion
24 Detachment prevention piece
31 Bottom wall portion
32 First insulating wire swaging portion
33 Second insulating wire swaging portion
34, 34A to 34D Standing claw
34E Claw
50 Terminal cover
51 Cylindrical portion
52 Rectangular tubular portion
53 Front end wall
100 Insulating wire
101 Core wire
102 Insulating coating
111, 112 Non-woven fabric

The invention claimed is:

1. A terminal metal fitting-equipped insulating wire comprising:

an insulating wire;

a terminal connection portion connected to a partner terminal metal fitting; and a wire holding portion provided at a back of the terminal connection portion and configured to hold, in a pressure-bonded state, the insulating wire, wherein the insulating wire includes a core wire formed from a conductive body having a horizontally-elongated rectangular cross section, and an insulating coating having two pieces of band-shaped non-woven fabric bonded in a state in which the two pieces of the band-shaped non-woven fabric overlap with each other with the core wire being sandwiched in an upper-to-lower direction, the wire holding portion includes a bottom wall portion on which the insulating wire is placed, a first insulating wire swaging portion formed continuously to one side edge of the bottom wall portion, and a second insulating wire swaging portion formed continuously to the other side edge of the bottom wall portion, a plurality of claws configured to bite into the insulating wire upon swaging of the insulating wire are formed at at least one of the bottom wall portion, the first wire swaging portion and the second wire swaging portion, and the plurality of claws formed at either one of the bottom wall portion, the first wire swaying portion or the second wire swaging portion are arranged in a substantially V-shape as viewed in a plane and consist of:

a first plurality of claws arranged along a left diagonal virtual line of the V-shape, extending diagonally backward from a front end portion of the bottom wall portion, the first wire swaging portion or the second wire swaging portion toward a center of the bottom wall portion, the first wire swaging portion or the second wire swaging portion in a length direction thereof; and a second plurality of claws arranged along a right diagonal virtual line of the V-shape, extending diagonally backward from the center toward a back end portion of the bottom wall portion, the first wire swaging portion or the second wire swaging portion.

2. The terminal metal fitting-equipped insulating wire according to claim 1, wherein each claw is a standing claw.

3. The terminal metal fitting-equipped insulating wire according to claim 1, wherein the plurality of claws are formed only at the bottom wall portion among the bottom wall portion, the first insulating wire swaging portion, and the second insulating wire swaging portion.

4. The terminal metal fitting-equipped insulating wire according to claim 3, wherein the plurality of claws include claws formed at different positions of the bottom wall portion in a width direction thereof.

5. The terminal metal fitting-equipped insulating wire according to claim 1, wherein the plurality of claws are formed at either one of the first insulating wire swaging portion and the second insulating wire swaging portion.

6. The terminal metal fitting-equipped insulating wire according to claim 5, wherein the plurality of claws include claws formed at different positions of the insulating wire swaging portion provided with the plurality of claws in a direction perpendicular to each side edge of the bottom wall portion.

7. The terminal metal fitting-equipped insulating wire according to claim 1, wherein lengths of the first insulating wire swaging portion and the second insulating wire swaging portion in the direction perpendicular to each side edge of the bottom wall portion are formed as such lengths that both insulating wire swaging portions at least partially overlap with each other when one insulating wire swaging portion is bent to overlap with an upper surface of the bottom wall portion after the other insulating wire swaging portion has been bent to overlap with the upper surface of the bottom wall portion in a state in which a connection-side end portion of the insulating wire is placed on the bottom wall portion.

8. The terminal metal fitting-equipped insulating wire according to claim 1, wherein the plurality of claws are formed at each of the bottom wall portion, the first insulating wire swaging portion, and the second insulating wire swaging portion.

9. The terminal metal fitting-equipped insulating wire according to claim 1, wherein the plurality of claws are formed at each of the first insulating wire swaging portion and the second insulating wire swaging portion among the bottom wall portion, the first insulating wire swaging portion, and the second insulating wire swaging portion.

10. The terminal metal fitting-equipped insulating wire according to claim 8, wherein lengths of the first insulating wire swaging portion and the second insulating wire swaging portion in a direction perpendicular to each side edge of the bottom wall portion are formed as such lengths that both insulating wire swaging portions do not overlap with each other when one insulating wire swaging portion is bent to overlap with an upper surface of the bottom wall portion after the other insulating wire swaging portion has been bent to overlap with the upper surface of the bottom wall portion in a state in which a connection-side end portion of the insulating wire is placed on the bottom wall portion.

11. The terminal metal fitting-equipped insulating wire according to claim 1, wherein one end portion of the insulating wire is electrically and mechanically connected to the wire holding portion.

12. The terminal metal fitting-equipped insulating wire according to claim 1, wherein each claw is a standing claw, and in the state in which the insulating wire is pressure-bonded by the wire holding portion, the standing claw penetrates through the core wire and the two pieces of the band-shaped non-woven fabric, and a tip end of the standing claw exposed from the insulating wire is folded back.

13. The terminal metal fitting-equipped insulating wire according to claim 1, wherein each claw is a standing claw, the at least one of the bottom wall portion, the first wire swaging portion and the second wire swaging portion comprises a first standing claw having a great blade height and a second standing claw having a small blade height, and in the state in which the insulating wire is pressure-bonded by the wire holding portion, the first standing claw penetrates through the core wire and the two, pieces of the band-shaped non-woven fabric and has a folded-back tip end, and the second standing claw enters the insulating wire without penetrating through the insulating wire.

14. The terminal metal fitting-equipped insulating wire according to claim 1, wherein, in a state in which the insulating wire is pressure-bonded by the wire holding portion, each of the plurality of claws bites into the core wire and the two pieces of the band-shaped non-woven fabric.

15. The terminal metal fitting-equipped insulating wire according to claim 1, wherein a length of at least one of the claws from a bottom end to a tip end of the at least one of the claws is equal to or longer than a height of the insulating wire in the upper-to-lower direction.

16. The terminal metal fitting-equipped insulating wire according to claim 1, wherein a length of at least one of the claws from a bottom end to a tip end of the at least one of the claws is longer than a height of the insulating wire in the upper-to-lower direction.

* * * * *